United States Patent [19]

Thompson

[11] 4,376,347

[45] Mar. 15, 1983

[54] LIGHT POWERED MOBILE

[76] Inventor: Marion E. Thompson, 2807 N. Prospect, Colorado Springs, Colo. 80907

[21] Appl. No.: 303,500

[22] Filed: Sep. 18, 1981

[51] Int. Cl.[3] ..... G09F 19/00

[52] U.S. Cl. ..... 40/441

[58] Field of Search ..... 272/31 A, 8M; 40/441, 40/480, 473, 479

[56] References Cited

U.S. PATENT DOCUMENTS

| | | | |
|---|---|---|---|
| 2,074,878 | 3/1937 | Weber | 272/31 A |
| 2,508,880 | 5/1950 | Amato | 272/31 A |
| 2,511,394 | 6/1950 | Wynnyk | 40/480 |
| 2,611,071 | 9/1952 | Palmieri | 40/480 |
| 3,136,544 | 6/1964 | Strayer | 272/31 A |
| 3,590,505 | 7/1971 | Benchley | 40/473 |
| 3,654,716 | 4/1972 | Moss | 40/473 |
| 4,222,558 | 9/1980 | Tinguely | 272/31 A |
| 4,227,327 | 10/1980 | Thompson | 40/473 |

FOREIGN PATENT DOCUMENTS 534931 2/1955 Belgium .

*Primary Examiner*—Gene Mancene
*Assistant Examiner*—Wenceslao J. Contreras
*Attorney, Agent, or Firm*—Cushman, Darby & Cushman

[57] ABSTRACT

A display assembly is provided which most desirably comprises a lamp mobile having a base, a d.c. motor mounted within the base with a shaft extending outwardly from it, and the mobile mounted to the shaft. The interconnection between the mobile and the shaft can be a curved distal end of the shaft engaging an abutment surface of a similar radius of curvature formed within a body member of the mobile, with the shaft loosely received by the mobile, so that the mobile will rotate at a slower speed than the shaft. The base is screw-threaded onto the top of a cylindrical projection from a lamp harp, and a solar cell which powers the d.c. motor is also mounted to the lamp so that it receives light from the lamp light bulb. A pair of planar portions, one received by the lamp socket and the other mounting the solar cell, and interconnected by a hinge, may be utilized to properly position the cell to receive light from the lamp. The mobile includes a rod mounted at its central portion to the mobile body member, with a weight mounted to one end of the rod and a display item, such as an airplane model, mounted to the other end of the rod. Cooperating magnets disposed on the rod and base can cause the plane to move up and down as it rotates.

29 Claims, 11 Drawing Figures

Fig. 1
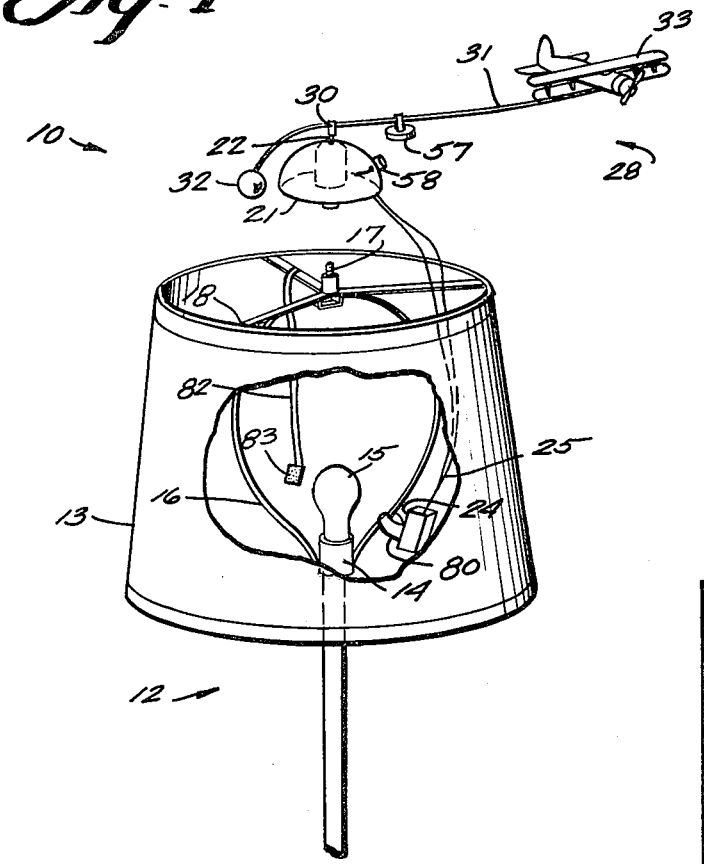
Fig. 2
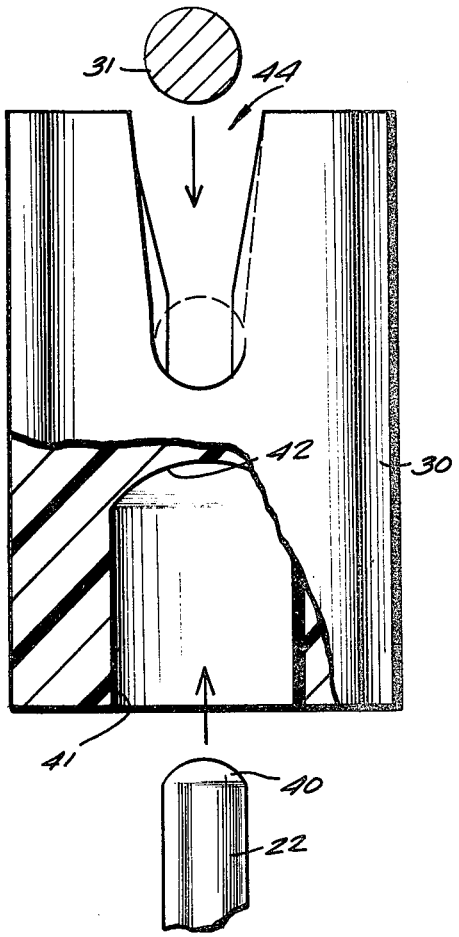
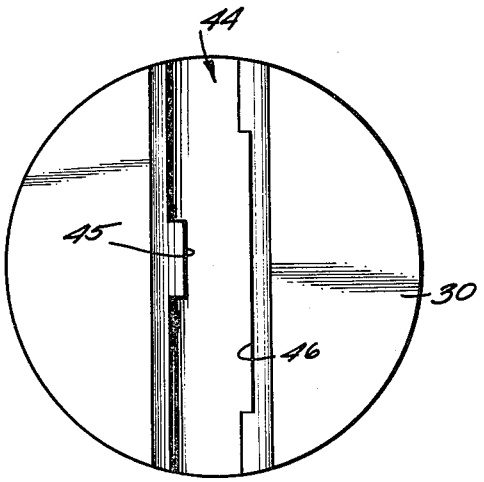
Fig. 3

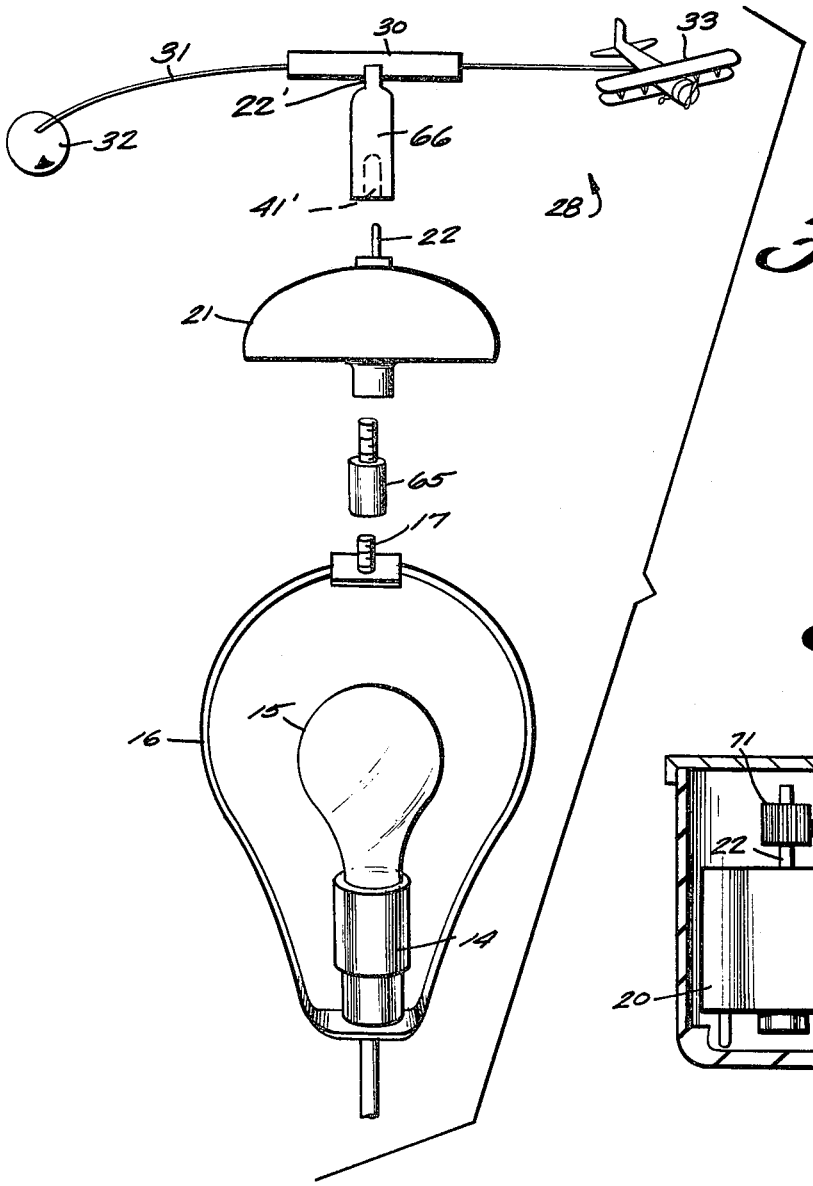
Fig. 7
Fig. 8
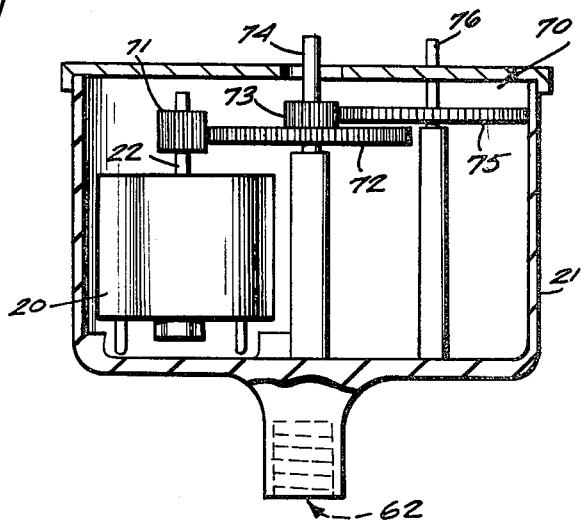
Fig. 9
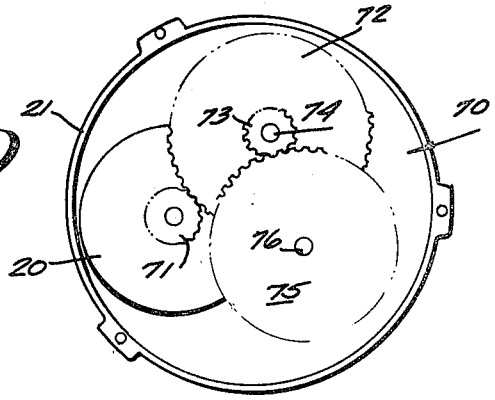

LIGHT POWERED MOBILE

BACKGROUND AND SUMMARY OF THE INVENTION

The invention relates to animated display devices which are useful as conversation pieces, novelty items, point-of-purchase advertising devices, or to perform a wide variety of other functions. The assemblies according to the invention are characterized by simple construction, flexibility, versatility, and ease of installation and utilization, and inexpensiveness of component parts. The assemblies according to the present invention are particularly adapted for use in association with lamps, christmas tree lights, or the like, obtaining the power necessary to effect animation thereof from such light sources, there being no necessity to separately plug in the devices to a separate electrical outlet.

According to one aspect of the present invention, a lamp mobile assembly is provided. The mobile includes a base, a d.c. motor mounted within the base and having a shaft extending outwardly therefrom, and a mobile means. The mobile means includes a shaft-receiving body member, a metal rod mounted to the body member, a weight mounted to one end of the rod, and a display item—such as a model airplane, stick figure, or the like—mounted to the other end of the rod. Means are provided for mounting the base to a lamp harp, and a solar cell is provided electrically interconnected to the d.c. motor. The mounting of the base to the lamp harp may be accomplished by screwing the base onto an exteriorly threaded cylinder extending upwardly from the top of the harp. The solar cell can be mounted to the lamp harp by spring fingers, can be suspended from the spider of the lamp shade, or can be mounted adjacent the lamp socket. The display item is caused to move vertically as it rotates by providing one or more magnets mounted on the base, and a magnet mounted to the rod between the display item and the body member.

The d.c. motor may comprise a motor with gear reduction means for rotating the display item at a substantially lower speed than the speed of rotation of the d.c. motor, which most desirably comprises an inexpensive single speed motor. The gear reduction means can comprise a pair of output shafts each extending from a different portion of the gear reduction means, and each having a different speed of rotation.

According to another aspect of the present invention, an assembly is provided that facilitates a speed reduction between a d.c. motor output shaft and a rotatable display item mounted to the shaft. The motor output shaft has a distal curved end having a given radius of curvature, and the shaft has a first predetermined cross-sectional area adjacent its distal end. The display device is mounted to the shaft by a body member, with means defining a bore in the body member having a second cross-sectional area greater than the first cross-sectional area, with the bore dimensioned to loosely receive the motor shaft within it. A termination of the bore comprises a curved abutment surface having generally about the same radius of curvature as the motor shaft. The display device preferably comprises the mobile described above, with the rod and weight so shaped and dimensioned, and the mounting means so constructed, so that the center of gravity of the mobile is closer to the d.c. motor than the area of interengagement between the motor shaft distal curved end and the curved abutment surface. If desired, a substantially planar air resistance-increasing member may be attached to the rod, increasing the air resistance of the mobile and thus slowing it down relative to the speed of rotation of the shaft.

According to another aspect of the present invention, an assembly is provided for mounting the solar cell to a lamp socket, particularly for use with the mobile and d.c. motor described above. The mount includes a body member having first and second substantially planar portions, with means defining a bore in the first body portion dimensioned to receive the socket therein, frictionally engaging the socket as it passes through the bore. A solar cell is mounted to the second body portion on a face thereof closest a light bulb when received by the socket. Hinge means interconnect the first and second body portions for allowing relative angular orientation therebetween to be adjusted, with the portions maintained in whatever relative angular orientation they have been moved to. Preferably the body member and hinge means comprise an integral piece of plastic, the hinge means comprising a thinned central portion of the plastic piece. The assembly may be utilized in association with an electric light for a christmas tree and with a christmas tree ornament which includes a music playing device, electrical interconnections between the solar cell and the music playing device supplying power from the cell to the music playing device.

It is the primary object of the present invention to provide a simple and versatile attention-getting assembly. This and other objects of the invention will become clear from an inspection of the detailed description of the invention, and from the appended claims.

BRIEF DESCRIPTION OF THE DRAWINGS

FIG. 1 is a perspective exploded view, with portions cut away for clarity, of an exemplary animated assembly according to the invention in association with a conventional lamp;

FIG. 2 is a side view, partly in cross-section and partly in elevation, of components of a power drive mechanism utilizable with the assembly of FIG. 1;

FIG. 3 is a top plan view of the components of FIG 2;

FIG. 7 is an exploded perspective detail view of the assembly of FIG. 1 illustrating optional extension members that may be utilized therewith to elevate the mobile with respect to the lamp;

FIG. 8 is a side view, partly in cross-section and partly in elevation, of an exemplary gear-reduction motor arrangement utilizable with the assembly of FIG. 1;

FIG. 9 is a top plan view, with the top cover removed for clarity, of the arrangement of FIG. 8;

DETAILED DESCRIPTION OF THE DRAWINGS

Figure 4:
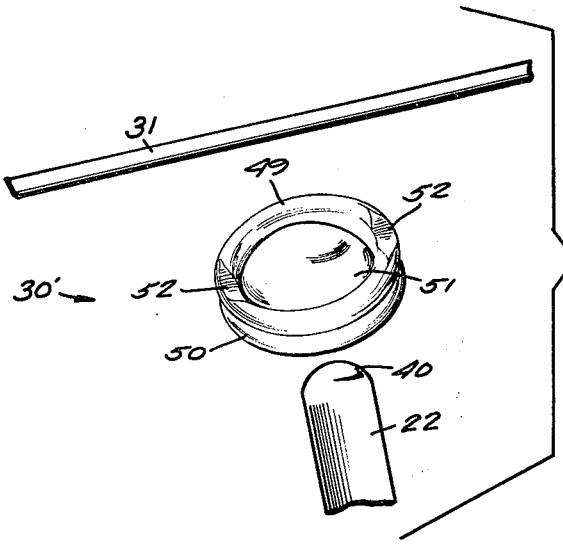
FIG. 4 is a perspective exploded view of exemplary components of another drive device utilizable with the assembly of FIG. 1.

An exemplary animated assembly according to the present invention is shown generally by reference numeral 10 in FIG. 1, in association with a conventional lamp shown generally by reference numeral 12. A conventional lamp includes a lamp shade 13, socket 14 for mounting a light bulb 15, harp 16, exteriorly threaded upstanding cylindrical member 17 from the top of harp 16, and lamp shade spider 18.

Major components of the device 10 include a d.c. motor 20 (see FIG. 6), a base 21 mounting the d.c. motor therewithin, and a motor shaft 22 extending outwardly (upwardly) from the base 21. A solar cell 24 is electrically interconnected by wires 25 to the motor 20. Mounted atop the shaft 22 is an animated display assembly, preferably comprising a lamp mobile assembly, illustrated generally by reference numeral 28.

Figure 6:
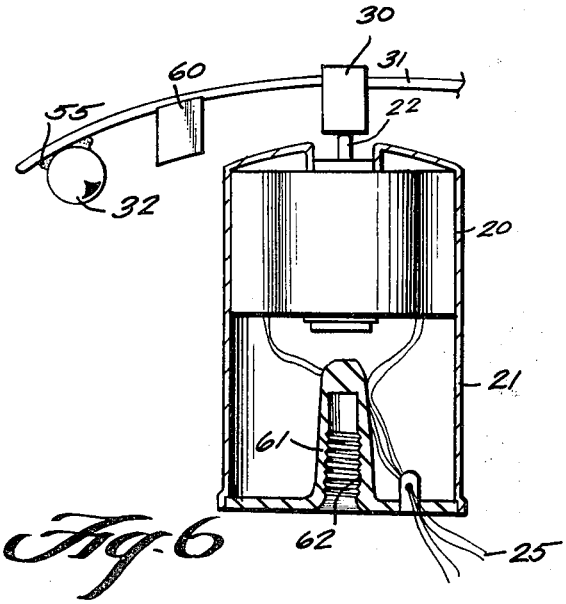
FIG. 6 is a side view, partly in cross-section and partly in elevation, showing the base member and cooperating components of the assembly of FIG. 1.

Lamp mobile assembly 28 includes a body member 30 (see FIGS 2, 6, and 7 in particular) which mounts to the shaft 22, a metal rod 31 attached to the body member 30 adjacent a central portion thereof, a weight, such as steel ball 32, mounted to one end of the rod 31, and a display item—such as model airplane 33—mounted to the other end of the rod 31. As can be seen in FIGS. 1 and 6, means are provided for mounting the rod 31 to the body member 30, and the rod 31 and weight 32 are so shaped and dimensioned, that the center of gravity of the rod-weight-display item system is closer to the motor 20 than the area of interengagement between the motor shaft 22 and the body member 30.

One exemplary form that the body member 30, and shaft 22, may take is illustrated in detail in FIGS. 2 and 3. In this case, the shaft 22 has a distal curved end 40 having a given radius of curvature, and the shaft has a first predetermined cross-sectional area adjacent the distal end 40. Most commonly the distal end 40 will comprise a spherical sector, or the curved end of a paraboloid or hyperboloid of revolution. The body member 30 has means defining a bore 41 therein, the bore 41 having a second cross-sectional area greater than the cross-sectional area of distal end of shaft 22, and dimensioned to loosely receive the shaft 22 therein. For instance both the shaft 22 and the bore 41 may be circular in cross-section, with the bore 41 diameter being substantially greater than the diameter of the shaft 22. A termination of the bore 41 is provided comprising a curved abutment surface 42 having generally about the same radius of curvature as the distal end 40 of shaft 22. The surface 42 thus also may be spherical sector or paraboloid or hyperboloid of revolution, and the bore 41 may be formed merely as an extension of the surface 42. With the shaft 22 extending into the bore 41 with the surfaces 40, 42 engaging, and with the weight of the rod-weight-display item system supplying a force tending to maintain the surfaces 40, 42 in engagement, the shaft 22 will effect rotation of the body member 30, however since there is no tight interengagement therebetween there will be slippage, and the member 30 will rotate at a substantially lesser speed than the shaft 22.

As an alternative to the interconnection described above and illustrated in FIG. 2, an interconnection between motor shaft and power component may be provided such as shown in U.S. Pat. No. 4,227,327.

In the embodiment illustrated in FIGS. 2 and 3, the member 30 is composed of plastic, such as Delrin, and includes an upper channel 44 formed therein opposite the bore 41, and adapted to receive the rod 31. Surface portions, such as cooperating projection 45 and trough 46, may be provided along the sides of channel 44 to provide a spring clip action holding the rod 31 to the member 30 in whichever relative position they have when they are brought into engagement.

Another form that the component for interconnecting the rod 31 and shaft 22 may take is illustrated schematically by reference numeral 30' in FIG. 4. In this embodiment, a pair of eyelets 49, 50 comprise the body member 30'. The bottom eyelet 50 has the interior thereof closed and formed by a member 51 which provides the curved surface (42) for abutting the shaft distal end surface 40, while opposite raised edge portions 52 of upper eyelet 49 are flattened to receive the rod 31 thereon. Once the rod 31 is moved into engagement with the flattened portions 52 with a desired orientation therebetween, solder is used to attach the metal eyelet 49 to the metal rod 31.

Figure 5:
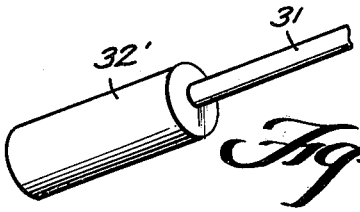
FIG. 5 is a detail perspective view illustrating a form of weight utilizable with the mobile of FIG. 1.

The weight 32 may take any desired form, and may be interconnected to the rod 31 in any desired manner. For instance it may take the form of a steel ball 32, which—as illustrated in FIG. 6—is tangential to rod 31 and connected thereto by solder 55. Alternatively, the weight may be a cylinder 32' (see FIG. 5) frictionally or screw-threadingly engaging the end of rod 31, or the weight may be another display item. The rod 31 is of small enough diameter and flexible enough with respect to the weight 32, 32' so that the end of the rod 31 supporting the weight 32, 32' is normally deflected downwardly during use (see FIGS. 1, 6, and 7). Alternatively the rod 31 can be bent so the end thereof adapted to be connected to the weight 32, 32' projects slightly downwardly, as illustrated.

Interconnection between the rod 31 and the display item 33 can be effected utilizing any desirable conventional means. The display item 33 can be attached to the top of the rod 31, or the rod 31 can suspend the display item 33, or penetrate a side portion thereof.

In order to provide for vertical movement (i.e. movement in a dimension parallel to the shaft 22) of the display item 33 one or more times during rotation thereof about the base 21 when powered by the motor 20, magnets 57, 58 (see FIG. 1) may be provided. One magnet 57 is mounted to rod 31 between body member 30 and display item 33, while one or more magnets 58 are mounted to the base 21 spaced substantially the same distance from the axis of rotation of shaft 22 as the magnet 57. The polarity of the magnets 57, 58 can be arranged so that they either attract or repel each other, in each case a tilting action of the rod 31 about the body member 30 (or the body member 30 with respect to the shaft 22) taking place when the rod 31 is rotated into position relative to base 21 so that the magnets 57, 58 are in close proximity.

In order to increase the air resistance of the mobile 28 and thereby further slow it down with respect to the speed of rotation of shaft 22, the substantially planar member 60 (see FIG. 6) may be utilized. This member 60 is attached to rod 31 (as by soldering), and merely increases the air resistance of the mobile 28, retarding it as it rotates about the axis of shaft 22.

Preferably the base member 21 comprises means for attaching it to the lamp harp 16, particularly the upstanding exteriorly threaded cylindrical member 17. As illustrated most clearly in FIG. 6, such attaching means preferably comprises an interiorly screw-threaded passage defining member 61 (the screw-threaded passage being illustrated by numeral 62) located in a portion of base 21 opposite shaft 22. Thus by merely screw-threading base 21 onto member 17, the mobile 28 may be properly mounted.

If it is desired to mount the mobile 28 higher above the harp 16, extension components can be utilized. For instance the extension component 65 illustrated in FIG. 7 may be connected between the base 21 of the threaded cylinder 17. Alternatively the extension component 66 may be interconnected between the body member 30 and shaft 22. The extension 66 may be designed so that an upper shaft extension 22′ thereof has the curved distal end 40 described above, in which case a bottom bore 41′ thereof tightly engages shaft 22; or, tight engagement between the shaft portion 22′ and the body member 30 may be provided, with the bore 41′ shaped with the curved abutment surface 42 cooperating with curved distal end 40 of shaft 22.

The relative speed between the mobile 28 and the motor 20 may be adjusted by other means than the interconnecting components described above. For instance a gear reduction means 70 (see FIGS. 8 and 9) may be utilized. In this case, a gear 71 may be mounted on motor output shaft 22, and cooperate with gears 72, 73 on a first output shaft 74, the gear 73 in turn cooperating with a gear 75 on second output shaft 76. In this case the body member 30 will have a bore tightly frictionally (or with a key) engaging either of the output shafts 74, 76, the speed reduction provided being dependent upon which of the two output shafts 74, 76 it engages.

Preferably the solar cell 24 is connected to a component of the lamp 12. For instance as illustrated in FIG. 1, the cell 24 may be connected by spring fingers 80 or the like directly to the harp 16, or cell 24 may be taped to the harp 16. Alternatively, a suspension member 82 can be provided extending downwardly from spider 18 and having adhesive means 83 formed on the distal end thereof for engaging the solar cell 24. For instance the suspension member 82 can be a strip of acetate tied to the spider 18, with the adhesive means 83 comprising a piece of double-faced tape.

Figure 10:
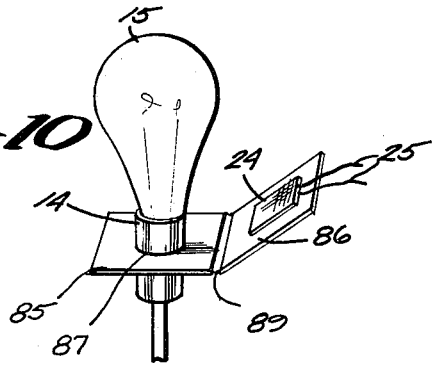
FIG. 10 is a perspective detail view showing an exemplary mechanism for mounting a solar cell of the assembly of FIG. 1 adjacent a light bulb.

FIG. 10 illustrates another mechanism according to the invention for attaching a solar cell adjacent a light source 15. In this case, the mounting assembly comprises a body member having first, 85, and second, 86, substantially planar portions. The first portion 85 includes means defining a bore 87 therein dimensioned to receive the socket 14, frictionally engaging the socket as it passes through the bore 87. The second body portion 86 mounts the solar cell 24 (as by double-faced adhesive tape) to a face thereof closest the lamp bulb 15 when received by socket 14. Hinge means 89 are provided interconnecting the body portions 85, 86 for allowing the relative angular orientation therebetween to be adjusted, with the portion 85, 86 maintaining whatever relative angular orientation they have been moved to. Ideally, the components 85, 86, 89 are formed of an integral piece of plastic, with the hinge means 89 comprising a thinned central portion of the plastic piece.

Figure 11:
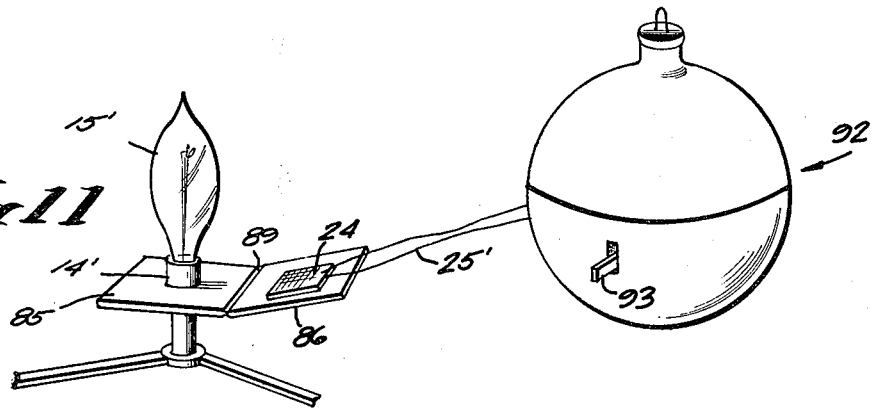
FIG. 11 is a perspective schematic view illustrating a solar cell mount like that of FIG. 10 in association with a christmas tree electric light bulb and ornament.

FIG. 11 illustrates the solar cell mounting mechanism of FIG. 10 in association with a christmas tree electric light bulb 15′ supported by socket 14′. The christmas light bulb 15′ is shown in combination with a christmas tree ornament 92, which includes interiorly thereof an electrically powered music playing device, which may be activated or deactivated by exterior switch 93. The electrical interconnections 25′ from solar cell 24 lead to the music playing device interiorly of the ornament 92 and supply the power to operate it.

Exemplary apparatus according to the invention having been described a typical mode of operation thereof will now be set forth, with particular reference to FIGS. 1, 2, and 6:

Steel ball 32 is connected by solder 55 to one end of rod 31, and the model airplane 33 is connected to the other end of rod 31. The rod 31 is then placed loosely in channel 44, and the lengthwise position thereof with respect to the body member 30 is adjusted until the ball 32 and plane 33 are balanced. Then the rod 31 is affixed to the body member 30 by the spring clip action provided by molded components 45, 46 as the rod 31 is pressed downwardly in channel 44.

Body member 30 is placed over shaft 22 extending outwardly from the base member 21, with the curved surfaces 40, 42 interengaging. The interiorly threaded passageway 62 of base member 21 is screw-threaded onto the threaded cylinder 17 upstanding from harp 16, the mobile 28 now being in place with respect to the lamp 12. The spring fingers 80 connected to solar cell 24 are then clipped onto harp 16 in a position wherein the cell 24 will receive the maximum amount of light from the light bulb 15, the wires 25 interconnecting the motor 20 and the cell 24.

When light bulb 15 is turned on, some of the light therefrom falls upon solar cell 24, which converts the light into electricity. The electricity moves through wire 25 to motor 20, resulting in the power thereof and shaft 22 rotating. As shaft 22 rotates it also effects rotation of body member 30, although at a slower speed since slippage is provided by the interconnections 40, 41, 42. The plane 33 thus slowly rotates about the shade 22, and each time the magnet 57 on rod 31 comes close to the stationary magnet 58 on base 21, the plane 33 dips downwardly, pivotal movement being allowed by the interengagement between the components 40, 41, 42.

It will thus be seen that according to the present invention, a simple, versatile, and inexpensive animated display device has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass equivalent structures and devices.

What is claimed is:

1. An assembly comprising: a base; a d.c. motor mounted with said base and having a shaft extending outwardly therefrom, the shaft having a distal curved end having a given radius of curvature, and the shaft having a first predetermined cross-sectional area adjacent said distal end; a solar cell; means electrically interconnecting said solar cell and said d.c. motor; and a display member including a mounting means, said mounting means including: a body member, means defining a bore in said body member having a second cross-sectional area greater than said first cross-sectional area and dimensioned to loosely receive said motor shaft therein, and a termination of said bore comprising a curved abutment surface having generally about the same radius of curvature as said motor shaft.

2. An assembly as recited in claim 1 wherein said display member comprises a rod, a weight mounted to one end of said rod, and a display item mounted to the other end of said rod; and means for mounting said rod to said body member.

3. An assembly as recited in claim 2 wherein said means for mounting said rod to said body member comprises means for mounting said rod to said body member, and wherein said rod and weight are so shaped and dimensioned, so that the center of gravity of said rod-weight-display item system is closer to said d.c. motor than is the area of interengagement between said motor shaft distal curved end and said curved abutment surface.

4. An assembly as recited in claim 1 wherein said body member comprises a pair of metal eyelets.

5. An assembly as recited in claims 2 or 3 wherein said base includes means for attaching it to a lamp harp.

6. An assembly as recited in claim 5 wherein said means for attaching said base to a lamp harp comprises an interiorly screw-threaded passage-defining member, opposite the motor shaft, for cooperating with an upstanding exteriorly threaded cylinder at the top of a lamp harp.

7. An assembly as recited in claim 5 further comprising means for mounting said solar cell to the lamp so that the cell will receive light from a bulb associated with the lamp.

8. An assembly as recited in claim 5 further comprising a light bulb-receiving socket associated with the lamp harp; and means for mounting said solar cell to said socket, said means comprising: a base member having a first portion with a bore formed therein and frictionally engaging said socket as said socket passes through said bore; a second portion of said base member for mounting said solar cell therein on a portion thereof facing a light bulb received by said socket when said first portion receives said socket; and hinge means for mounting said first and second portions of said base member together to allow the relative angular orientation therebetween to be adjusted with said portions maintained in whatever relative angular orientation they have been moved to.

9. An assembly as recited in claims 2 or 3 wherein said means for mounting said rod to said body member comprises a spring clip formed with said body member.

10. An assembly as recited in claims 2 or 3 wherein said body member is made, at least in part, of metal; and wherein said rod is metal; and wherein said means for mounting said rod to said body member comprises solder.

11. An assembly as recited in claim 2 wherein said rod is metal, and wherein said weight comprises a metal ball; and further comprising solder interconnecting said ball and rod adjacent one end of said rod with said rod tangential to said ball.

12. An assembly as recited in claim 1 wherein said shaft distal end comprises part of an extension member having one end thereof opposite said shaft distal end tightly engaging a shaft component of said d.c. motor.

13. A lamp mobile assembly comprising: a base; a d.c. motor mounted with said base and having a shaft extending outwardly therefrom; a mobile means comprising a shaft-receiving body member, a rod mounted to the body member, a weight mounted to one end of said rod, and a display item mounted to the other end of said rod; means for mounting said base to a lamp harp; a solar cell; means for electrically interconnecting said solar cell and said d.c. motor; and means for causing said display item to move in a dimension generally parallel to said shaft one or more times during rotation thereof about said base when powered by said d.c. motor, comprising a magnet mounted to said rod between said display item and said body member, and a magnet mounted to said base.

14. An assembly as recited in claim 2 further comprising means for causing said display item to move in a dimension generally parallel to said shaft one or more times during rotation thereof about said base when powered by said d.c. motor.

15. An assembly as recited in claim 14 wherein said display item moving means comprises a magnet mounted to said rod between said display item and said body member, and a magnet mounted to said base.

16. An assembly as recited in claim 13 wherein said means for attaching said base to a lamp harp comprises an interiorly screw-threaded passage-defining member, opposite the motor shaft, for cooperating with an upstanding exteriorly threaded cylinder at the top of a lamp harp.

17. An assembly as recited in claim 13 wherein said rod is metal, and wherein said weight comprises a metal ball; and further comprising solder interconnecting said ball and rod adjacent one end of said rod with said rod tangential to said ball.

18. An assembly as recited in claim 13 further comprising means for mounting said solar cell to the lamp so that the cell will receive light from a bulb associated with the lamp.

19. An assembly as recited in claim 18 wherein said means for mounting said solar cell to the lamp comprises means for mounting said cell directly to said lamp harp.

20. An assembly as recited in claim 13 wherein said d.c. motor includes gear reduction means contained within said base for reducing the output speed of said shaft vis-a-vis said motor.

21. An assembly as recited in claim 20 wherein two output shafts extend outwardly from said base, each output shaft extending outwardly from a different portion of said gear reduction means so that each output shaft rotates at a different speed.

22. An assembly as recited in claim 13 further comprising a substantially planar air-drag member mounted to said rod for increasing the air resistance of said mobile means as it rotates, and therefore reducing the speed of rotation thereof.

23. An assembly as recited in claim 22 further comprising a slip connection provided between said shaft and said mobile means shaft-receiving body member.

24. An assembly for mounting a solar cell to a light bulb receiving socket, comprising: a body member having first and second substantially planar portions; means defining a bore in said first body portion dimensioned to receive said socket therein, frictionally engaging said socket as it passes through the bore; a solar cell mounted to said second body portion on a face thereof closest to a light bulb when received by said socket; and hinge means interconnecting said first and second body portions for allowing the relative angular orientation therebetween to be adjusted, with said portions maintained in whatever relative angular orientation they have been moved to.

25. An assembly as recited in claim 24 wherein said body member and hinge means comprise an integral piece of plastic, said hinge means comprising a thinned central portion of said plastic piece.

26. An assembly as recited in claims 24 or 25 in combination with a christmas tree ornament which includes a music playing device, and electrical interconnections between said solar cell and said music playing device supplying power from said solar cell to said music playing device.

27. A lamp mobile assembly comprising: a base; a d.c. motor mounted with said base and having a shaft extending outwardly therefrom; a mobile means comprising a shaft-receiving body member, a rod mounted to the body member, a weight mounted to one end of said rod, and a display item mounted to the other end of said rod, means for mounting said base to a lamp harp; a solar cell; means for electrically interconnecting said solar cell and said d.c. motor; and means for mounting said solar cell to the lamp so that the cell with receive light from a bulb associated with the lamp, comprising a suspension member hanging down from a spider member connected to the lamp harp, and adhesive means for engaging said solar cell formed on a portion of said suspension member remote from said lamp spider.

28. A lamp mobile assembly comprising: a base; a d.c. motor mounted with said base and having a shaft extending outwardly therefrom; a mobile means comprising a shaft-receiving body member, a rod mounted to the body member, a weight mounted to one end of said rod, and a display item mounted to the other end of said rod; means for mounting said base to a lamp harp; a solar cell; means for electrically interconnecting said solar cell and said d.c. motor; a light bulb-receiving socket associated with the lamp harp; and means for mounting said solar cell to said socket, said means comprising: a base member having a first portion with a bore formed therein and frictionally engaging said socket as said socket passes through said bore; a second portion of said base member mounting said solar cell therein on a portion thereof facing a light bulb received by said socket when said first portion receives said socket; and hinge means for mounting said first and second portions of said base member together to allow the relative angular orientation therebetween to be adjusted with said portions maintained in whatever relative angular orientation they have been moved to.

29. A lamp mobile assembly comprising: a base; a d.c. motor mounted with said base and having a shaft extending outwardly therefrom; a mobile means comprising a shaft-receiving body member, a rod mounted to the body member, a weight mounted to one end of said rod, and a display item mounted to the other end of said rod; means for mounting said base to a lamp harp; a solar cell; and means for electrically interconnecting said solar cell and said d.c. motor; said d.c. motor including gear reduction means contained within said base for reducing the output speed of said shaft vis-a-vis said motor, and wherein two output shafts extend outwardly from said base, each output shaft extending outwardly from a different portion of said gear reduction means so that each output shaft rotates at a different speed.

* * * * *